United States Patent [19]

Johnson

[11] Patent Number: 4,696,455

[45] Date of Patent: Sep. 29, 1987

[54] ZIRCON AND MGO PREHEATABLE INSULATING REFRACTORY LINERS AND METHODS OF USE THEREOF

[75] Inventor: Howard B. Johnson, Cincinnati, Ohio

[73] Assignee: Consolidated Ceramic Products, Inc., Blanchester, Ohio

[21] Appl. No.: 666,492

[22] Filed: Oct. 30, 1984

[51] Int. Cl.[4] ..... C21C 5/44

[52] U.S. Cl. ..... 266/44; 266/280; 266/286; 501/121

[58] Field of Search ..... 266/280, 286, 281, 283, 266/44, 275; 501/94, 95, 108, 109, 121, 106; 164/437, 337; 264/36

[56] References Cited

U.S. PATENT DOCUMENTS

| | | | |
|---|---|---|---|
| 3,192,059 | 6/1965 | Good et al. | 501/106 |
| 3,303,032 | 2/1967 | Holt et al. | 501/106 |
| 3,458,329 | 7/1969 | Owens et al. | 501/109 |
| 3,498,235 | 3/1970 | Martinet | 501/121 |
| 3,514,302 | 5/1970 | Willmore et al. | 501/109 |
| 3,528,830 | 9/1970 | Davies | 501/106 |
| 3,578,473 | 5/1971 | Alper et al. | 501/121 |
| 3,917,110 | 11/1975 | Kiguchi | 266/280 |

FOREIGN PATENT DOCUMENTS

| | | | |
|---|---|---|---|
| 1478317 | 6/1977 | United Kingdom | 501/109 |
| 0668927 | 6/1979 | U.S.S.R. | 501/109 |

OTHER PUBLICATIONS

Harbison-Walker Refractories, "H-W Handbook of Refractory Practice", Second Edition pp. 47-65, 12/80.

Zirconia Silicate (Zircon), in: Oxide Ceramics, *Ryshkewitch, E.* (ed) pp. 397-406 (12/1960).

Silica Melt Equilibria, Rutgers Univ. Press, *W. Eitel* p. 17 (12/1951).

*Zircon and Zirconates,* High Temperature Oxides, Part II, Oxides of Rare Earths, Titanium, Zirconium, Hafnium, Niobium and Tantalum, Ed. Allen M. Alper, Academic Press, pp. 167-191 (1970).

Preparation and Strength of Fosterite-Zirconia Ceramic Composites, *Ceramic International,* S. Yangyun & R. J. Brook, 9(2) pp. 39-45, 1/1983.

Phase Diagrams for Ceramists 1975 Supplement, *The American Ceramic Society,* pp. 244-245, 12/75.

*Primary Examiner*—L. Dewayne Rutledge
*Assistant Examiner*—S. Kastler
*Attorney, Agent, or Firm*—Wood, Herron & Evans

[57] ABSTRACT

Novel preheatable molded refractory insulating liners and methods of use thereof for lining vessels, such as hot tops, ladles, tundishes, troughs, and pipes, etc., which serve to transfer molten metals, such as ferrous alloys, are disclosed. The new and vastly improved preheatable liners are suitable for developing effectively the required hot strength needed for casting molten metals at both vessel preheat temperatures and casting temperatures. The unique preheatable liners additionally possess the needed hot strength during the range of casting temperatures as are experienced in the metal making industry. The preheatable molded refractory insulating liners comprise a liner structure of predetermined shape, the liner structure comprising a molded uniform mixture containing a particulate refractory component comprised of zircon and MgO refractory grain and a binder therefore wherein the zircon and MgO refractory grain are in amounts proportioned such that the hot strength is developed at vessel preheat and metal casting temperatures which are in the range of about 1900° F. to about 3000° F. when such liners are heated for sufficient periods of time.

29 Claims, No Drawings

ZIRCON AND MGO PREHEATABLE INSULATING REFRACTORY LINERS AND METHODS OF USE THEREOF

BACKGROUND OF THE INVENTION

In the metal casting industry, it is customary to employ metal casting vessels, such as tundishes and ladles, etc., as means which serve to transfer various molten metals. Because of the corrosive nature of the liquid metals and the slags, and to prevent heat loss and premature solidification of the metals, the metal casting vessels are prevented from contacting with such metals and/or slags by lining the vessels with heat-insulating refractory boards. Additionally, a trend in the industry is to preheat these lined vessels to minimize heat loss from the initial molten metals poured through the vessels at the start of casting, and to remove, if possible, all sources of hydrogen derived from, for instance, moisture ($H_2O$) and/or organic compounds embodied in the refractory linings, which can be dissolved by and incorporated into the liquid metals passing through the lined vessels. In particular, when low hydrogen grades of steel are being cast, it is especially desirable to preheat such refractory lined vessels to remove all possible hydrogen sources which can serve only to contaminate the liquid metals.

In addition to driving off all sources of hydrogen, it is desirable to minimize the amount of unstable oxides, such as silica, which are present in the heat-insulating refractory boards. These unstable oxides, and in particular silica, can react with various elements contained in the molten metals and lead to the formation of oxide inclusions in the liquid metals. For example, some of the undesirable reactions of silica with various elements leading to the formation of oxide impurities are as follows:

$$3SiO_2+[4AL]\rightarrow 2AL_2O_3+[Si]$$

$$SiO_2+[2Fe]\rightarrow 2FeO+[Si]$$

The MnO and FeO formed can further attack the silica in the heat-insulating refractory linings by forming low melting liquid oxide slags at metal casting temperatures.

Unfortunately, the dilemma facing the metal-making industry concerning the addition of unstable oxides which act to lower sintering and solidus temperatures versus the use of pure, stable refractory oxides for refractoriness and molten metal purity is extremely difficult to overcome, especially with preheatable heat-insulating refractory boards which must sinter and develop sufficient hot strength for casting at sub-casting temperatures which can be sometimes as much as about 1,000° F. lower than casting temperatures.

Another problem presently associated with the heat-insulating refractory linings for the metal casting vessels involves shrinkage of such linings upon heating. One solution within the metal-making industry to this problem is to fire such linings at temperatures higher than those that are expected during use, so that shrinkage during use can be avoided. Again, since preheating can occur at temperatures as low as about 1000° F. below casting, this presents a further problem with the current preheatable boards.

In the case of cold tundish practice, i.e., the pouring of a molten metal into a tundish without first preheating it, the temperature increases as the molten metal enters the tundish and decomposes the organic binder under reducing conditions forming carbon bonds. The carbon bonds hold the refractory grain together giving the tundish lining the required hot strength. As the carbon bonds are dissolved by the molten metal and oxidized, sintering of the refractory grain occurs over time. Thus, in cold tundish practice, the organic binder decomposition gives carbon bonds allowing the use of more stable refractory oxides which sinter more slowly and at higher temperatures, i.e., MgO and silica.

Nevertheless, in casting, the temperature associated with cold tundish linings increases quickly to that of casting such that by the time the carbon bonds are completely disintegrated, the linings are still held together by the formation of ceramic bonds resulting from the sintering of the refractory oxides. Because preheating may sometimes last up to, for example, 12 hours before casting actually begins, the linings utilized in cold tundish practice are unsuited for preheating use. The problem basically is due to oxidation of the carbon bonds within the linings at preheat temperatures which are generally too low for ceramic bonds to form resulting in usually soft and weak linings which will collapse due to their own weight or wash away as the molten metal enters the vessels.

In the past, several attempts or approaches without success have been made to overcome the problems presently associated with preheatable heat-insulating refractory boards for metal casting vessels. For example, large amounts of low-melting glass formers, such as borax, have been incorporated into the linings in an effort to stick the refractory grain together at preheat temperatures. Unfortunately, the glassy or liquid bonds allow the preheated linings to be deformed easily at preheat and casting temperatures after the carbon bonds burn out. Further, the preheated linings generally fail to develop the requisite hot strength for casting when preheated at preheat temperatures for extended periods of time prior to the start of casting. As a result, it has generally been found that at both preheat and casting temperatures, the liners would collapse or wash away.

An additional problem associated with the use of low-melting glass formers is that they are generally thermodynamically unstable to, for instance, ferrous alloys. In the case of $B_2O_3$, it can be reduced resulting in the incorporation of boron into the molten metals, such as ferrous alloys, that can alter the properties of the ferrous alloys as well as produce oxide inclusions.

Other types of preheatable linings are those made with the addition of about 5% to about 20% quartz (silica) for the purpose of bonding with MgO. Unfortunately, these preheatable boards have two serious drawbacks. First, the addition of quartz or other silica forms utilized by these liners is sufficiently high enough to cause formation of oxide inclusions by reaction of the molten metals with the linings. In order to minimize liquid metal contamination, the metal manufacturers specify that the quartz or free silica levels should be as low as possible. Secondly, presence of finely divided quartz or free crystalline silica can become airborne when, for instance, the boards are removed from the vessels after use presenting health hazards to the metal manufacturers and workers.

Examples of still other types of preheatable linings are those which contain about 85%–90% magnesite and about 5% to about 10% calcium fluoride. The calcium fluoride is typical of a strong fluxing agent which reacts with oxides to develop a liquid bonding phase at preheat temperatures. These linings, like those utilizing the low-melting glass formers, develop a liquid bonding phase when the organic binder is burnt out at, for instance, 1900° F. and up (preheat temperatures). The linings, unfortunately, are also very soft and weak at such temperatures after the organic binder is oxidized. Thus, as with the preheatable linings containing low melting glass formers, these preheatable linings fail to develop the sufficient hot strength for casting when heated at preheat temperatures for typical preheat periods of time.

In summary, previous attempts or approaches have been made to develop suitable preheatable insulating refractory liners. Heretofore no satisfactory preheatable heat-insulating refractory liner has been developed which can overcome the problems aforementioned. Basically, the past preheatable liners fall into two categories: those in which quartz is added in unacceptable amounts to form a ceramic bond; and those in which low melting materials are added to develop a liquid phase at preheat temperatures as an unsatisfactory attempt to protect the carbon bonds from oxidation and to bond the refractory grain and promote sintering.

In other words, all of the preheatable heat-insulating refractory liners provided hitherto invariably necessarily lack some of the key fundamental qualities required to develop sufficient hot strength at preheatable or sub-casting temperatures for the typical range in which preheating times occur. Consequently, there are strong commercial needs for preheatable heat-insulating refractory liners for metal casting vessels that can initiate the development of hot strength at preheat temperatures, that can withstand preheat temperatures for extended periods of preheat time, that can withstand molten metal erosion and corrosion, that will not experience substantial shrinkage on use, and that has minimum amounts of free silica and hydrogen content.

SUMMARY OF THE INVENTION

In brief, the present invention seeks to alleviate the above-mentioned problems and shortcomings of the present state of the art through the discovery of novel preheatable molded refractory insulating liners and methods of use thereof for lining metal casting vessels intended to contain, for instance, ferrous alloys, such as steel and in particular low hydrogen grades of steel. In a preferred embodiment, the present invention is directed to a preheatable molded refractory insulating liner for a casting vessel suitable for developing sufficient hot strength at vessel preheat and metal casting temperatures which are in the range of about 1900° F. to about 3000° F. comprising a liner structure of predetermined shape, the liner structure comprising a molded uniform mixture containing a particulate refractory component comprised of zircon and MgO refractory grain and a binder for the component to maintain the predetermined shape at least prior to the preheat temperatures wherein the zircon and MgO refractory grain are in amounts proportioned in the liner structure to facilitate the formation of fosterite bonding which results in increased hot strength at vessel preheat and metal casting temperatures when such a liner structure is heated for a sufficient period of time. Typically, in the industry preheat times can be from about one half-hour and extend to about twelve hours or more. Preferably, the particulate refractory component comprises about 75% to about 98.5% by weight of the liner a grain mixture of zircon and MgO refractory grain being in a ratio from about 1:1.5 to about 1:24, respectively. The MgO refractory grain may be derived from, for instance, natural, seawater or brine magnesite, periclase grain, or other suitable sources, or mixtures thereof plus, if any, incidental impurities. The MgO refractory grain and the zircon are the main essential constituents responsible for the development of the hot strength at the vessel preheat and metal casting temperatures. At such temperatures, it is believed that the MgO refractory grain and zircon react as follows to form the fosterite bonds and zirconia needed for hot strength and refractoriness:

$$2MgO + ZrO_2 \cdot SiO_4 \rightarrow Mg_2SiO_4 + ZrO_2.$$

It is thought that the formation of zirconia and fosterite enhances the desirable hot strength and corrosion resistance to the molten metals, such as ferrous alloys, and slag. It should be appreciated, however, that the formation of fosterite and zirconia is believed to occur over the entire range of vessel preheat and metal casting temperatures which are on the order of about 1900° F. to about 3000° F. More particularly, the vessel preheat temperatures, for instance, can range from, for example, about 1900° F. to about 2400° F. whereas, in the case of ferrous alloys, the metal casting temperatures are generally at about 2800° F. or above.

In a further feature of this invention, the particulate refractory component may contain in addition to the zircon and MgO refractory grain a suitable refractory filler in acceptable amounts, such as olivine or zirconia.

Therefore, the new and vastly improved preheatable liner structures provide means for developing effectively the increased hot strength needed for casting molten metals at both vessel preheat and metal casting temperatures. Further, the unique preheatable liners possess the necessary hot strength during the range of casting temperatures that are experienced in the metal making industry and especially the ferrous alloy making industries. In effect, a feature of the present invention is to provide preheatable molded refractory insulating liners that possess corrosion-erosion resistance to metal making environments which is greatly superior to that of the common commercial preheatable refractories used heretofore. Thus, the present invention provides a solution to the art that has long sought suitable liners for preheating and makes it now possible to preheat casting vessels lined with the preheatable refractory insulating liners of this invention for extended periods of time prior to the start of casting. Further, it is found that extended preheating advantageously enhances the development of the desired increased hot strength in the liners of the present invention.

Magnesite and zircon refractory compositions for fabricating refractory bricks having utility incident to the glass and metal making industries have been heretofore known in the art. Examples of refractory bricks formulated from such compositions can be found in U.S. Pat. No. 3,303,032, U.S. Pat. No. 3,192,059 and U.S. Pat. No. 3,528,830. It also has been heretofore known, as described in U.S. Pat. No. 3,303,032, that mixtures of stabilized zirconia, fosterite and periclase have resulted only after prolonged firing of such bricks at temperatures generally far in excess of those encountered at low vessel preheat temperatures.

In the literature, it has been reported that the decomposition of zircon to produce zirconia and amorphous silica generally occurs at about 1600° C. (2980° F.). Zirconia silicate (Zircon). IN: Ryshkewitch, E. (Ed); Oxide Ceramics. Academic Press pp 399–406 (1960). In addition, it has been reported that basic substances such as MgO decompose zircon at about 1240° C. (2264° F.). W. Eitel, "Silica Melt Equilibria", Rutgers University Press, New Brunswick, N.J. p. 17 (1951). This agrees with R. F. Rea, *J. Am. Ceramic Soc.*, 22, 95 (1929) who reported MgO to be among several oxides which react with zircon to form melting slag mixtures. Thus, the early literature and U.S. Patents teach that zircon is decomposed by MgO at about 2264° F. and develops a fosterite matrix only after prolonged firing at temperatures generally far in excess of the usual low vessel preheat temperatures associated with the preheatable liners presently available.

Recently, S. Yangyun and R. J. Brook: Preparation and Strength of fosterite - Zirconia Ceramic Composites. *Ceramics International.* 9(2):39–45 (1983) described the reaction of magnesium oxide (MgO) with zircon ($ZrO_2 \cdot SiO_2$) as follows: $2MgO + ZrO_2 \cdot SiO_2 \rightarrow 2MgO \cdot SiO_2 + ZrO_2$. The authors therein used a low temperature calcined reactive fine grain MgO intimately mixed with finely milled zircon. The reactants were milled together in a micronizer and pressed into pellets. They reported that about 10% reaction was achieved at 1100° C. (2012° F.) in two hours.

Notwithstanding the fact that such teachings as to zircon and MgO refractory compositions have been well known in the glass and metal making industries, it has been heretofore unknown to utilize zircon and MgO refractory compositions to form fosterite at low vessel preheat temperatures. Further, it has been heretofore unknown to utilize such compositions to fabricate preheatable molded refractory insulating liner structures for casting vessels. Moreover, it has been surprisingly discovered that such compositions in the liners react to facilitate development of effective hot strength at low vessel preheat temperatures.

To improve the quality of the molten metals including ferrous alloys, and especially low hydrogen grades of steel, during casting, the heat-insulating refractories employed to line the casting vessels which come into contact with the molten metals should be composed of the most stable oxides possible (i.e., the stronger the chemical bonding of the oxides, the higher the melting point). Unfortunately, this means that temperatures greater than preheatable temperatures which are generally from about 1900° F. to about 2400° F. are required to sinter the refractory grain of the stable oxides present in the linings. Thusly, a balance or compromise has to be struck between the refractory stable oxides and impurities utilized in the present heat-insulating refractory boards. The refractory stable oxides must have enough impurities, but without sacrificing quality of the casting metals, to develop a dense sinter surface at temperatures of about 2800° F. or higher. The types and amounts of unstable impurities which act to lower temperatures needed for sintering and solidus, however, must be controlled to maintain the needed heat-insulating refractory lining requirements and to minimize the contamination of the casting metals by the unstable oxides. The present invention, however, has remarkably overcome this arduous dilemma by providing a unique blend of stable and unstable oxides which is suitable for developing the necessary refractoriness and hot strength at vessel preheat and casting temperatures while developing a dense sinter at about 2800° F. without significantly contaminating the molten metals, such as ferrous alloys, with impurities during casting.

In a further feature of the present invention, the binder component may be derived from organic and/or inorganic binders or mixtures thereof in the range from about 1.5% to about 15% by weight. The inorganic binder may, for instance, constitute low melting fluxing compounds, such as boric acid. Additionally, the preheatable liners may contain a fibrous material component which may also be derived from organic and/or inorganic materials in the range from 0% to about 10% by weight. In keeping with the invention, the preheatable liners may further contain a thixotropic substance, such as bentonite, in amounts ranging from 0% to about 5% by weight.

In still a further feature of the present invention resides in providing preheatable molded refractory insulating liner structures suitable for lining casting vessels like hot tops, ladles, tundishes, troughs, or pipes, etc. for conveying molten ferrous alloys. The preheatable liners, if desired, can be molded into the form of a plurality of predetermined shaped inserts, such as tundish boards.

An especially desirable corrosion-erosion resistant preheatable molded refractory insulating liner according to this invention comprises by weight about 80% to about 95% a particulate refractory component containing MgO refractory grain and zircon wherein the MgO refractory grain and zircon are in a ratio of about 5:1 to about 18:1, respectively, about 1% to about 8% fibrous material, about 1.5% to about 10% binder, and about 0.5% to about 5% a thixotropic substance. As noted above, the MgO refractory grain may be derived from, for instance, natural, seawater or brine magnesite, periclase grain, or other suitable sources, or mixtures thereof. The lower silica and hydrogen content of the preheatable structures provide a further feature for reasons recited above; that is, the cast molten metals and particularly the ferrous alloys are distinctly purer as a result of less contamination presently experienced from high silica and hydrogen content associated with the common preheatable refractories available hitherto.

A preferred form of the present invention possessing the high degree of hot strength developed at vessel preheat and metal casting temperatures comprises by weight about 10% zircon and about 80% MgO refractory grain plus incidental impurities, wherein the MgO is preferably derived from dead burned natural, seawater or brine magnesite, periclase grain or mixtures thereof which may range from about 80% to about 98% MgO purity, the balance being binder, and if desired fibrous material or bentonite or mixtures thereof. Keeping the silica and hydrogen contents low in this preferred form, the same as aforesaid, will also provide distinctly purer cast molten metals.

Other incidental impurities are merely those of extremely minor contaminants which result from the ordinary impurity contents normally associated with different grades of raw material sources for MgO, zircon, etc. The total amount of impurities should be kept to a minimum, if possible, to reduce or avoid possible detrimental effects to the above-noted properties and structural characteristics.

In still another feature of the present invention is directed to a method of casting using a casting vessel comprising the steps of providing within the vessel a preheatable molded refractory insulating liner of this invention, heating the vessel to at least a vessel preheat temperature to initiate the development of hot strength in the preheatable liner for casting at metal casting temperatures, and introducing a molten metal, such as a ferrous alloy, into the vessel.

Thusly, it can be appreciated that the special features and unique advantages of the preheatable molded refractory insulating liners of this invention makes the same highly effective refractory liners suitable for preheating for extended periods of time prior to the start of molten metal casting.

The above and other features and advantages of the invention, including various novel details of construction and composition, will now be more particularly described with reference in the detailed description and pointed out in the claims. It will be understood that a composition for a preheatable molded refractory insulating liner embodying the invention is shown in the example by way of illustration only and not as a limitation of the invention. The principles and features of this invention may be employed in various and numerous embodiments without departing from the scope of the invention.

DETAILED DESCRIPTION OF THE INVENTION

By way of illustrating and providing a better appreciation of the present invention, the following detailed description and example are given concerning the preheatable molded refractory insulating liners of the invention and their properties or characteristics.

In accordance with the present invention, it is directed to providing a preheatable molded refractory insulating liner for lining a casting vessel suitable for developing sufficient hot strength at vessel preheat and metal casting temperatures which are on the order of about 1900° F. to about 3000° F. when such a liner is heated for a sufficient period of time. This is accomplished in the present instance by means of a preheatable molded refractory insulating liner comprising a liner structure of predetermined shape, the liner structure comprising a uniform molded mixture containing a particulate refractory component comprised of zircon and MgO refractory grain, and a binder therefore. In addition, the preheatable liner preferably contains a fibrous material and, if desired, minor amounts of bentonite or other suitable thioxtropic substances.

In the specification, the term "hot strength" refers to a liner having sufficient hot strength to support itself during extended preheating and to withstand erosion resulting from a molten metal entering a vessel during casting. In other words, the preheatable liners made and used in accordance with the teachings of this invention unexpectedly and advantageously generally do not soften or weaken, collapse or wash away after being preheated by a molten metal entering the vessel, as currently experienced with other prior art preheatable liners. Additionally, the preheatable liners of the present invention are less prone to contaminate the molten metals because of their low free silica and low hydrogen contents.

In a preferred embodiment, the preheatable molded refractory insulating liners are formed of by weight of about 75% to about 98.5% a particulate refractory component comprised of zircon and MgO refractory grain being in a ratio from about 1:1.5 to about 1:24, respectively, about 1.5% to about 15% binder, 0% to about 10% fibrous material and 0% to about 5% a thixotropic substance. Preferably, the zircon is about 5% to about 15%, and most preferably about 10% by weight of the liner. The zircon, also known as zirconium silicate ($ZrSiO_4$ or $ZrO_2 \cdot SiO_2$), and sometimes known as hyacinth, jargon, etc., can be derived from natural or synthetic products, or any other suitable sources not inconsistent with the teachings of this invention. It has been surprisingly discovered that when zircon, and especially finely comminuted zircon, or zirconium silicate, is intimately mixed with MgO refractory grain in sufficient amounts and made into a molded refractory insulating liner for a casting vessel, the zircon and MgO refractory grain unexpectedly react at vessel preheat temperatures which are in the range of about 1900° F. to about 2400° F. to develop sufficient hot strength as a result of the formation of fosterite bonding when such a liner is heated for a sufficient period of time. To this end, it is not necessary, but highly preferable, that the entire amount of zircon, or zirconium silicate, used be very finely comminuted. For example, preferably about 95% of the zircon particles should pass through a 325 mesh screen, and more preferably substantially all should pass through a 400 mesh screen. Most preferably, the zircon should have an average particle size of about 10 microns. In particular, ground zircon sand and especially zircon flour, for instance, are suitable sources of highly comminuted zircon to be employed pursuant to the invention. The term zircon employed herein is to be understood in each instance as referring to a chemical combination of zirconium, silicon and oxygen designatable by the formula $ZrSiO_4$ and irrespective of its origin be it synthetic or natural.

In carrying out the invention, the MgO refractory grain, also known as magnesium oxide or magnesia, can be derived from any suitable sources and especially from sources, such as natural, seawater or brine magnesite, periclase grain, or any other suitable sources, or mixtures thereof. The magnesite or periclase grain, however, preferably is of the type commonly referred to as dead burned magnesite or dead burned periclase. By "dead burned" magnesite or periclase is meant magnesite or periclase fired to high temperatures to produce a hydration resistant grain consisting essentially of well-sintered low porosity periclase crystals and this grain structure distinguishes it from the more reactive lower temperature calcined caustic magnesites. Nevertheless, it should be understood that it is preferred that the MgO refractory grain content, whether derived from natural, seawater or brine magnesite, periclase grain, or other suitable sources, should be substantially pure. By "substantially pure", it means containing at least about 80% MgO by weight on the basis of an oxide analysis, with the remainder, if any, being only minor amounts of incidental impurities. Generally, the best results are achieved when the particle size distribution of the MgO refractory grain is not too coarse or too fine. Preferably, such particles should be sized so that no more than about 40% are retained on a 50 mesh screen and no more than about 40% can pass through a 325 mesh screen. More preferably, no more than about 15% of the MgO refractory grain particles should be retained on a 50 mesh screen and no more than about 30% should pass through a 325 mesh screen.

In accordance with a preferred aspect of the invention, it is surprisingly found that the use of a blend of different magnesite sources for MgO refractory grain achieve the best results. As noted above, the blend should be of sources for MgO refractory grain having an MgO content of at least about 80%. Additionally, sources for MgO refractory grain should be selected to minimize silica and hydrogen content. Further, sources of MgO refractory grain should be selected on the basis of their low tendency to hydrate due to their high dead burning temperatures and as a result of their composition. For example, it is astonishingly found that a blend of equal parts of about 88% MgO magnesite and about 95% MgO magnesite is optimal for minimizing silica and hydrogen content while still achieving a strong sinter and hot strength. The 95% MgO magnesite contains about 2% to about 3% $SiO_2$ and the 88% MgO magnesite contains about 7% to about 8% $SiO_2$. Thus, in a most preferred form of the present invention, the preheatable molded refractory insulating liners comprise by weight about 10% zircon, about 40% of an about 88% MgO magnesite and about 40% of an about 95% MgO magnesite wherein the zircon and MgO refractory grain are in a ratio of about 1:8, respectively, about 1.5% to about 15% binder, 0% to about 10% fibrous material, and 0% to about 5% a thixotropic substance.

In another feature of the present invention, a suitable refractory filler may be added in acceptable amounts to the particulate refractory component which comprises zircon and MgO refractory grain. Exemplary of such fillers are olivine and zirconia wherein the olivine may be by weight of the liner from 0% up to about 70% and the zirconia may be by weight of the liner from 0% up to about 80%. When a refractory filler is added to the particulate refractory component, however, it should be understood that such a mixture will still be by weight of the preheatable liner from about 75% up to about 98.5% as aforementioned. It should further be understood that the zircon and MgO refractory grain are in the stated ratios not inconsistent with the teachings of this invention so that sufficient hot strength is developed in the preheatable liners at vessel preheat temperatures and metal casting temperatures. It should additionally be understood that the refractory fillers preferably should have a particle size approximating the size distribution of the MgO refractory grain. The advantages to adding a refractory filler to the particulate refractory component include, for instance, a reduction in manufacturing cost or to improve the corrosion resistance of the liner. An example of a preheatable refractory liner containing olivine as a refractory filler has a composition comprising by weight olivine about 62%, zircon about 4%, MgO refractory grain about 25%, binder about 1.5% to about 15%, fibrous material 0% to about 10% and a thixotropic substance 0% to about 5%. It can be noted that in this exemplary composition the MgO refractory grain and zircon ratio by weight is about 6:1, respectively.

In carrying out the invention, the binder component may be derived from any suitable binder or mixtures of binders of those known in the refractory making and allied industries including organic and/or inorganic binders. Typically, vessel preheating is conducted at about 1900° F. to about 2400° F. and more typically between about 2000° F. and 2300° F. These preheat conditions cause the organic binders incorporated within the liners to burn out, for instance, starting at the hot face and sometimes throughout the entire board thickness, of course, depending upon preheat time, temperature and board thickness. Nonetheless, up until the point of burnout, the organic binders serve to hold or bind the other materials together and comprises by weight of the liner from about 1.0% to about 10%. Samples of organic binders suitable to be employed in the liners of the present invention include, but not limited to, starches, cereals, natural or synthetic resins, such as amino resins, phenolic resins or mixtures thereof More particularly, the phenol-formaldehyde and urea-formaldehyde resins are best suited for use and most preferably is the phenol-formaldehyde resin. It should be appreciated that when the phenol-formaldehyde resin is employed, a catalyst such as hexamethylenetetraamine, also known as HMTA, Hexa, methenamine, hexamine, aminoform, etc., should be added in sufficient amounts to polymerize the phenolformaldehyde resin to bond the refractory grains for making a rigid structure suitable for use as a liner.

In addition to providing binding support prior to the burnout of organic binder, the inorganic binder generally serves to stick or hold the particulate refractory component together during preheat conditions particularly after the organic binder has been consumed or burnt out. To this end, it is believed that the inorganic binder forms a glassy or viscous phase under preheat conditions developing characteristics suitable for sticking or binding the particulate refractory component together. In other words, an inorganic binder can act as a temporary binder characterized as a low melting fluxing material which aids in maintaining the particulate refractory component together subsequent to organic burnout under preheat conditions and until the fosterite refractory bonding develops. Examples of inorganic binders suitable for use are boric acid, borax, colemanite, etc., and preferably boric acid. Generally, boric acid comprises by weight from about 0.5% to about 5% of the structure. In addition, upon heating boric acid is converted to $B_2O_3$ which advantageously promotes sintering of the MgO refractory grain for improving the hot strength of the preheatable liner.

In further keeping with the invention, as to the fibrous materials, the following is preferred but not limited thereto: inorganic fibrous materials such as rockwool, slag wool, glass wool, refractory aluminum silicate fibers, and especially slag wool; and organic fibrous materials such as cellulosic materials derived from paper, paper wood, sawdust, wood meal, synthetic organic fibers or the like, and particularly paper. These fibrous materials generally serve to reinforce the preheatable liners so that the liners are not damaged by any impact during the manufacturing, shipment and installation. Additionally, the fibrous materials serve to prevent the particulate refractory component from settling out of the slurry and to control porosity and permeability of the liner. Further, by the use of such a fibrous material, the resulting preheatable liners can become a porous board which has low bulk density, whereby the heat-insulating effect thereof is improved. As noted above, the fibrous material represents by weight of the liner from 0% to about 10% and preferably about 5%.

As to the incorporation of a thixotropic substance, it generally acts as a thickening agent or forming aid during preparation of the desired shape and generally comprises by weight of the liner from 0% to about 5%. Exemplary of thixotropic substances are bentonite, methylcellulose, alginates, etc., and especially bentonite. As to the bentonite, it is preferred that the calcium bentonite is employed as opposed to the sodium bentonite.

In accordance with the present invention, the preheatable molded refractory insulating liner structures are suitable for forming linings for casting vessels, such as hot tops, ladles, tundishes, troughs and pipes etc., which are intended to contain molten ferrous alloy metals. The versatility of these structures enables them to be shaped, for example, into the form of a plurality of predetermined shaped inserts. Preferably, the preheatable liners of this invention are in the form of a plurality of shaped boards employed in tundishes.

As is conventional in the art of refractory insulating liners, manufacture can be readily done, for instance, by vacuum forming or injection molding methods which, for example, comprise forming an aqueous slurry of solids comprising a mixture containing a particulate refractory component, a binder therefore and, most preferably, a fibrous material component. Bentonite or other suitable thixotropic substances may also be employed as discussed above. Because of the copious amounts of water utilized in making the aqueous slurry, vacuum sources which are well-known in this art for removing substantial amounts of water are preferably employed. The raw batch of materials are suitably proportioned to provide the desired final mixture and preferably are intimately premixed in the slurry form prior to vacuum forming. After the preparation of a sufficient amount of a desired slurry, the material is usually poured into preformed molds of the desired shape and subjected to sufficient sub-atmospheric or vacuum conditions to suck away a substantial amount of the liquid in the slurry so that the formed shapes can be removed from the mold and dried. The wet vacuum formed shapes are passed through conventional hot air dryers to remove or evaporate virtually all the water and to heat the entire structure thickness to a suitable temperature for curing the organic and/or inorganic binder. The thickness of the liner when making a board may range, for instance, from about ¾ of an inch to about 2 inches.

According therefore to a further feature of the present invention, there is provided a method of casting using a casting vessel which serves to transfer molten metals, such as ferrous alloys, comprising the steps of providing in the casting vessel a preheatable molded refractory insulating liner structure of this invention, heating the casting vessel to at least a vessel preheat temperature to initiate the development of hot strength in the preheatable liner structure for casting at metal casting temperatures and introducing a molten metal, such as a ferrous alloy, into the casting vessel.

EXAMPLE

The following represents two preferred compositions A and B for manufacturing a preheatable molded refractory insulating liner in accordance with this invention:

| Composition | Ingredient | % |
|---|---|---|
| A | Phenol-formaldehyde resin | 2.30 |
| | Hexamethylenetetraamine | 0.20 |
| | Paper | 1.40 |
| | Slag wool | 3.30 |
| | Calcium bentonite | 1.60 |
| | Magnesite: about 88% MgO | 40.60 |
| | Magnesite: about 95% MgO | 40.60 |
| | Zircon Flour | 10.00 |
| | | 100.00% |
| | Boric Acid 2.5% of dry batch weight. | |
| B | Phenol-formaldehyde resin | 2.30 |
| | Hexamethylenetetraamine | 0.20 |
| | Paper | 1.40 |
| | Slag wool | 3.30 |
| | Calcium bentonite | 1.60 |

-continued

| Composition | Ingredient | % |
|---|---|---|
| | Magnesite: about 88% MgO | 24.50 |
| | Zircon Flour | 4.00 |
| | Olivine | 62.70 |
| | | 100.00% |
| | Boric Acid 1.0% of dry batch weight. | |

TABLE I

Effect of Preheat and Contact with Molten Steel on the Porosity of the Tundish Board Manufactured with Composition A Disclosed in the Example

| | POROSITY | SPECIFIC GRAVITY |
|---|---|---|
| PREHEAT | | |
| Prior to preheat | 50.95% | 3.33 g/cc |
| After 1 hour 2100° F. Preheat | 56.03% | 3.55 g/cc |
| AFTER CASTING | | |
| Sample - 6 inches under metal line 1 heat - medium carbon steel, medium manganese steel | | |
| Hot Face - (11/16" thick) | 22.2% | 3.44 g/cc |
| Cold Face - (¾" thick) | 54.3% | 3.57 g/cc |
| Sample - 18 inches under metal line 1 heat medium carbin steel, 1.50% manganese steel | | |
| Hot Face - (5/8" thick) | 14.5% | 3.37 g/cc |
| Cold Face - (¾" thick) | 53.9% | 3.51 g/cc |
| GUNNABLE TUNDISH COATING | | |
| After 1 heat sample uniform throughout 1" thick coating | 34.6% | 3.40 g/cc |

Preheat increased the porosity by 10% by burning out organic binders sintering and reacting to form fosterite. This effect was also observed by the increase in specific gravity when the low specific gravity organic material was removed.

Table I shows that after contact with a molten ferrous alloy, the preheatable refractory board formed a dense (approximately 20% porosity), impermeable 0.5 inch thick layer in contact with the steel. The porosity of the cold side of the board remained high at about 55%. The dense hot face contained some closed pores and some oxide contamination which lowered the apparent specific gravity compared to the cold face and the preheated specific gravities.

X-ray diffraction showed that zircon and MgO refractory grain was consumed, and that fosterite and cubic zirconia were formed at tundish preheat condition and both fosterite and cubic zirconia were found present in the hot face and the cold face of the tundish boards after casting ferrous alloys.

In use, the dense board hot face which developed resisted and reduced erosion and steel contamination. The high porosity on the back of the board advantageously gave lower thermal conductivity through the board, thus, lower temperatures at the permanent lining and less heat loss from the vessel resulted. Such boards had low erosion with high manganese steels, low hydrogen contribution to the steel and were preheated to about 2300° F. for up to about seven hours without adversely affecting their hot strength during casting. The gunnable coating referred to in Table I had an intermediate (34%) porosity through its entire thickness. It failed to develop a dense layer at the hot face.

It was observed that the preheatable tundish boards developed sufficient hot strength and remained substantially rigid and intact during the vessel preheat temperatures and metal casting temperatures.

The present invention may, of course, be carried out in other specific ways than those herein set forth without departing from the spirit and essential characteristics of the invention. The present embodiments are, therefore, to be considered in all respects as illustrative and not restrictive and any changes coming within the meaning and equivalency range of the appended claims are to be embraced therein.

What is claimed is:

1. A preheatable molded refractory insulating liner structure prior to preheating of predetermined shape having insulating porosity for temporarily lining a casting vessel and for developing sufficient hot strength to maintain the integrity of the structure at vessel preheat and metal casting temperatures which are in the range of about 1900° F. to about 3000° F. during its use as a liner in a casting vessel, comprising a molded uniform mixture having a substantial insulating porosity on the order of about 50% prior to preheating containing a particulate refractory component in an amount of about 75% to about 98.5% by weight of said preheatable liner structure of a mixture of zircon and MgO refractory grain wherein said zircon and MgO refractory grain are in a ratio of about 1:1.5 to about 1:24, respectively, and a binder for said component and inorganic fibrous material in sufficient amounts to maintain the predetermined shape of insulating porosity at least prior to the preheat temperatures wherein said zircon and MgO refractory grain are of a particle size in said preheatable liner structure to facilitate the formation of fosterite bonding which results in increased hot strength with substantial maintenance of insulating porosity and shape without substantial shrinkage at both the vessel preheat temperatures of about 1900° F. to about 2400° F. and higher metal casting temperatures when said preheatable liner structure is used as a liner in a casting vessel and heated for a sufficient period of time.

2. A preheatable insulating liner of claim 1 wherein said vessel is selected from the class consisting of a hot top, ladle, tundish, pipe or trough.

3. A preheatable insulating liner of claim 1 wherein said liner structure is in the form of a plurality of shaped inserts.

4. A preheatable insulating liner of claim 1 wherein said liner structure is a tundish board.

5. A preheatable insulating liner of claim 1 wherein said MgO refractory grain is derived from the class consisting of magnesite, periclase or mixtures thereof.

6. A preheatable insulating liner of claim 7 wherein said MgO refractory grain is derived from a blend of different grades of magnesite, perclase or mixtures thereof having an MgO content ranging from at least about 80%.

7. A preheatable insulating liner of claim 1 wherein said binder component is an inorganic binder.

8. A preheated insulating liner of claim 7 wherein said inorganic binder is boric acid.

9. A preheatable insulating liner of claim 1 further comprising an organic fibrous material.

10. A preheatable liner of claim 9 wherein said inorganic fibrous material is slag wool or alumina silicate.

11. A preheatable liner of claim 9 wherein said organic fibrous material is a cellulose fiber

12. A preheatable insulating liner of claim 1 wherein said zircon is about 5% to about 15% by weight of said liner structure.

13. A preheatable insulating liner of claim 1 wherein said zircon is about 10% by weight and said MgO refractory grain is about 80% by weight of said liner structure wherein said MgO refractory grain is derived from about equal parts of about 88% MgO magnesite and about 95% MgO magnesite.

14. A preheatable insulating liner of claim 1 wherein said liner structure comprises about 75% to about 98.5% by weight said particulate refractory component, 1% to about 10% fibrous material, about 1.5% to about 15% said binder component and 0% to about 5% a thixotropic substance.

15. A preheatable insulating liner of claim 1 further comprising a refractory filler selected from the class consisting of olivine or zirconia wherein said olivine is in an amount by weight of said liner structure ranging from 0% to about 70% and said zirconia is in an amount by weight of the liner ranging from 0% to about 80%.

16. A preheatable insulating liner of claim 15 comprising by weight:

(a)
phenol-formaldehyde resin: about 2.3%
hexamethylenetetraamine: about 0.2%
paper: about 1.4%
slag wool: about 3.3%
bentonite: about 1.6%
magnesite: about 88% MgO: about 24.5%
zircon flour: about 4.0%
olivine: about 62.7%; and (b) boric acid: about 1.0% of dry weight of (a).

17. A method of casting with a vessel which serves to transfer molton metals wherein the vessel is temporarily lined with a preheatable molded refractory insulating liner structure prior to preheating of predetermined shape having insulating porosity, said method comprises the steps of providing in the vessel the preheatable molded refractory insulating liner structure of predetermined shape which is suitable for developing sufficient hot strength to maintain the integrity of the structure at vessel preheat and metal casting temperatures which are in the range of about 1900° F. to about 3000° F. wherein the preheatable molded refractory insulating liner structure comprises (a) a molded uniform mixture having a substantial insulating porosity on the order of about 50% prior to preheating containing a particulate refractory component in an amount of about 75% to about 98.5% by weight of said preheatable liner structure of a mixture of zircon and MgO refractory grain wherein the zircon and MgO refractory grain are in a ratio of about 1:1.5 to about 1:24, respectively, and (b) a binder for the component and inorganic fibrous material in sufficient amounts to maintain the predetermined shape of insulating porosity at least prior to the preheat temperatures wherein the zircon and MgO refractory grain are of a particle size in the preheatable liner structure to facilitate the formation of fosterite bonding which results in increased hot strength with substantial maintenance of insulating porosity and shape without substantial shrinkage at both the vessel preheat and higher metal casting temperatures when the preheatable liner structure is heated for a sufficient amount of time;

heating the vessel to at least a vessel preheat temperature of about 1900° F. to about 2400° F. to initiate development of hot strength in the preheatable liner structure for casting at metal casting temperatures; and introducing a molten metal into the vessel with substantial maintenance of insulating porosity and shape of said liner structure without substantial shrinkage.

18. A method of claim 17 wherein the vessel is selected from the class consisting of a hot top, a ladle, tundish, pipe or trough.

19. A method of claim 17 wherein said preheatable insulating liner structure is formed of a plurality of spaced inserts.

20. A method of claim 17 wherein said preheatable insulating liner structure is a tundish board.

21. A method of claim 17 wherein the molten metal is a ferrous alloy.

22. A method of claim 21 wherein the ferrous alloy is a low hydrogen grade of steel.

23. A method of developing hot strength in a preheatable insulating liner structure of predetermined shape for a tundish comprising the steps of:

lining the tundish with the preheatable molded refractory insulating liner boards suitable for developing sufficient hot strength to maintain the integrity of the boares at vessel preheat and metal casting temperatures which are in a range of about 1900° F. to about 3000° F. wherein the preheatable molded refractory insulating liner boards comprise (a) a molded uniform mixture having a substantial insulating porosity on the order of about 50% prior to preheating containing a particulate refractory component comprised of zircon in an amount of about 10% by weight and MgO refractory grain in an amount of about 80% by weight of the liner structure wherein the MgO refractory grain is derived from about equal parts of about 88% MgO magnesite and about 95% MgO magnesite, and (b) a binder for the component and inorganic fibrous material in sufficient amounts to maintain the predetermined shape of insulating porosity at least prior to the preheat temperatures wherein the zircon and MgO refractory grain are of a particle size in the preheatable liner structure to facilitate the formation of fosterite bonding which results in increased hot strength with substantial maintenance of insulating porosity and shape without substantial shrinkage at the vessel preheat and metal casting temperatures when the preheatable liner boards are heated for a sufficient period of time; and preheating the lined tundish to a preheat temperature of at least about 1900° F. such that as a result of said preheating the refractory insulating tundish board initiates development of hot strength for casting molten metals with substantial maintenance of insulating porosity and shape of said boards without substantial shrinkage.

24. A method of developing hot strength in a preheatable insulating liner structure of predetermined shape for a tundish comprising the steps of:

lining the tundish with the preheatable molded refractory insulating liner structure suitable for developing sufficient hot strength to maintain the integrity of the structure at vessel preheat and metal casting temperatures which are in the range of about 1900° F. to about 3000° F. wherein the preheatable molded refractory insulating liner structure comprises (a) a molded uniform mixture having a substantial insulating porosity on the order of about 50% prior to preheating containing a particulate refractory component comprised of about 75% to about 98.5% by weight of said preheatable liner structure a mixture of zircon and MgO refractory grain wherein the zircon and MgO refractory grain are in a ratio of about 1:1.5 to about 1:24, respectively, (b) a refractory filler which is selected from the class consisting of olivine or zirconia, and (c) a binder for the component and inorganic fibrous material in sufficient amounts to maintain the predetermined shape of insulating porosity at least prior to the preheat temperatures wherein the zircon and MgO refractory grain are of a particle size in the preheatable liner structure to facilitate the formation of fosterite bonding which results in increased hot strength with substantial maintenance of insulating porosity and shape without substantial shrinkage at the vessel preheat and metal casting temperatures when the preheatable liner structure is heated for a sufficient period of time; and preheating the lined tundish to a preheat temperature of at least about 1900° F. such that as a result of said preheating the preheatable insulating liner structure of predetermined shape initiates development of the hot strength for casting molten metals with substantial maintenance of insulating porosity and shape of said structure without substantial shrinkage.

25. A preheatable insulating liner of claim 1 wherein said binder component is an organic binder.

26. A preheatable insulating liner of claim 25 wherein said organic binder is selected from the class consisting of urea formaldehyde resin, phenolformaldehyde resin or starch or mixtures thereof.

27. A preheatable insulating liner of claim 1 wherein said binder component comprises a mixture of inorganic and organic binders.

28. A preheatable molded refractory insulating liner for a casting vessel suitable for developing sufficient hot strength at vessel preheat and metal casting temperatures which are in the range of about 1900° F. to about 3000° F. comprising:

a liner structure of predetermined shape, said liner structure comprising by weight:

(a)

phenol-formaldehyde resin: about 2.3%
hexamethylenetetraamine: about 0.2%
slag wool: about 3.3%
paper: about 1.4%
bentonite: about 1.6%
magnesite-about 88% MgO grade: about 40.6%
magnensite-about 95% MgO grade: about 40.6%
zircon: about 10.0%; and (b) boric acid: about 2.5% of dry weight of (a)

wherein said zircon and magnesites are in amounts proportioned in said liner structure to facilitate the formation of fosterite bonding which results in increased hot strength at the vessel preheat and metal casting temperatures when said liner structure is heated for a sufficient period of time.

29. A preheatable insulating liner structure of claim 1 wherein said zircon comprises particles wherein about 95% of the zircon particles pass through a 325 mesh screen and said MgO refractory grain comprises particles wheren no more than about 40% of the MgO refractory grain particles are retained on a 50 mesh screen or pass through a 325 mesh screen.

* * * * *